US010097930B2

(12) United States Patent
Nakagawa et al.

(10) Patent No.: US 10,097,930 B2
(45) Date of Patent: Oct. 9, 2018

(54) TONALITY-DRIVEN FEEDBACK CANCELER ADAPTATION

(71) Applicant: Starkey Laboratories, Inc., Eden Prairie, MN (US)

(72) Inventors: Carlos Renato Calcada Nakagawa, Eden Prairie, MN (US); Kelly Fitz, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 226 days.

(21) Appl. No.: 15/133,910

(22) Filed: Apr. 20, 2016

(65) Prior Publication Data

US 2017/0311091 A1 Oct. 26, 2017

(51) Int. Cl.
*H04R 25/00* (2006.01)
*H04R 3/02* (2006.01)

(52) U.S. Cl.
CPC ..... *H04R 25/453* (2013.01); *H04R 3/02* (2013.01); *H04R 25/30* (2013.01); *H04R 25/45* (2013.01); *H04R 25/505* (2013.01); *H04R 2225/021* (2013.01); *H04R 2225/023* (2013.01); *H04R 2225/025* (2013.01); *H04R 2430/03* (2013.01)

(58) Field of Classification Search
CPC ..... H04R 3/002; H04R 3/02; H04R 25/30; H04R 25/45; H04R 25/453; H04R 25/505; H04R 2225/021; H04R 2225/023; H04R 2225/025; H04R 2430/03
USPC .... 381/312, 317, 318, 320, 71.1, 71.8, 71.9, 381/71.11, 71.12, 71.13, 71.14, 83, 93, 381/94.1, 94.2, 94.3
See application file for complete search history.

(56) References Cited

U.S. PATENT DOCUMENTS 8,452,034 B2 5/2013 Theverapperuma
8,553,899 B2 * 10/2013 Salvetti ..... H04M 9/082 381/317
8,681,999 B2 3/2014 Theverapperuma et al.
8,744,104 B2 * 6/2014 Theverapperuma ..... H04R 25/453 381/312
2006/0215852 A1 9/2006 Troxel
2008/0095388 A1 4/2008 Theverapperuma
(Continued)

FOREIGN PATENT DOCUMENTS

EP 2080408 B1 8/2012
WO WO-2007113282 A1 10/2007

OTHER PUBLICATIONS

"European Application Serial No. 17167386.6, Extended European Search Report dated Aug. 30, 2017", 6 pgs.
(Continued)

*Primary Examiner* — Huyen D Le
(74) *Attorney, Agent, or Firm* — Schwegman Lundberg & Woessner, P.A.

(57) ABSTRACT

Disclosed herein, among other things, are apparatus and methods for tonality-driven feedback canceler adaptation for hearing devices. Various embodiments include a method of signal processing an input signal in a hearing device to mitigate entrainment, the hearing device including a receiver and a microphone. The method includes detecting strength of tonality of the input signal by estimating a second derivative of subband phase of the input signal, and adjusting parameters of an adaptive feedback canceler of the hearing device based on the detected tonality.

20 Claims, 2 Drawing Sheets

(56) References Cited

U.S. PATENT DOCUMENTS

2009/0245552 A1 10/2009 Salvetti
2014/0348361 A1* 11/2014 Theverapperuma ..... H04R 25/453
381/318

OTHER PUBLICATIONS

Bello, J.P., et al., "A tutorial on onset detection in music signals", IEEE Trans. Speech Audio Process., 13, (2005), 1035-1047.
Gil-Cacho, J.M., et at, "Wiener variable step size and gradient spectral variance smoothing for double-talk-robust acoustic echo cancellation and acoustic feedback cancellation", Signal Processing, 104, (Jun. 7, 2013), 30 pgs.

* cited by examiner

TONALITY-DRIVEN FEEDBACK CANCELER ADAPTATION

TECHNICAL FIELD

This document relates generally to hearing systems and more particularly to tonality-driven feedback canceler adaptation for hearing devices.

BACKGROUND

Hearing devices provide sound for the wearer. Some examples of hearing devices are headsets, hearing aids, speakers, cochlear implants, bone conduction devices, and personal listening devices. Hearing aids provide amplification to compensate for hearing loss by transmitting amplified sounds to their ear canals. In various examples, a hearing aid is worn in and/or around a patient's ear.

Adaptive feedback cancellation is used in many modern hearing aids. Adaptive feedback cancellation algorithms perform poorly in the presence of strongly self-correlated input signals, such as pitched speech and music. The performance degradation results in lower added stable gain, and audible artifacts, referred to as entrainment. Signal processing systems that reduce entrainment by processing the output of the hearing aid can restore stable gain, but introduce additional audible sound quality artifacts. These artifacts may occur during voiced speech, but are most egregious for music signals, in which persistent tones aggravate the entraining behavior and magnify the sound quality artifacts.

There is a need in the art for improved feedback cancellation to mitigate unwanted adaptive feedback cancellation artifacts, such as those from entrainment, in hearing devices.

SUMMARY

Disclosed herein, among other things, are apparatus and methods for tonality-driven feedback canceler adaptation for hearing devices. Various embodiments include a method of signal processing an input signal in a hearing device to mitigate entrainment, the hearing device including a receiver and a microphone. The method includes detecting strength of tonality of the input signal by estimating a second derivative of subband phase of the input signal, and adjusting parameters of an adaptive feedback canceler of the hearing device based on the detected tonality.

Various aspects of the present subject matter include a hearing device including a microphone configured to receive audio signals, and a processor configured to process the audio signals to correct for a hearing impairment of a wearer. The processor is further configured to detect strength of tonality of the audio signals by estimating a second derivative of subband phase of the audio signals, and adjust parameters of an adaptive feedback canceler of the hearing device based on the detected tonality.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

Figure 1:
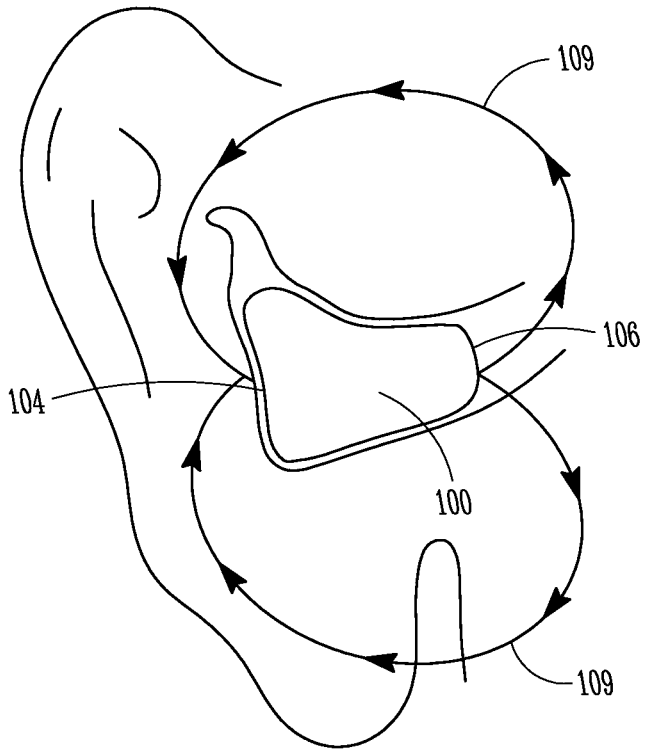
FIG. 1 is a diagram demonstrating, for example, an acoustic feedback path for one application of the present system relating to an in the ear hearing aid application, according to one application of the present system.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present system may be employed in a variety of hardware devices, including hearing devices. The present detailed description describes hearing devices using hearing aids as an example. However, it is understood by those of skill in the art upon reading and understanding the present subject matter that hearing aids are only one type of hearing device. Other hearing devices include, but are not limited to, those described in this document.

Digital hearing aids with an adaptive feedback canceller usually perform poorly from artifacts when the input audio signal to the microphone is quasi-periodic or strongly self-correlated over short time scales. The feedback canceller may use an adaptive technique that exploits the correlation between the microphone signal and the delayed receiver signal (the feedback signal) to update a feedback canceller filter to model the external acoustic feedback path. A self-correlated input signal results in an additional correlation between the receiver and the microphone signals. The adaptive feedback canceller cannot differentiate this correlation between the receiver and the microphone signals from the natural correlation between the receiver and the acoustic feedback signals, and incorporates characteristics of the self-correlated input signal in its model of the external acoustic feedback path. This results in artifacts, called entrainment artifacts, due to non-optimal modeling of the external acoustic feedback path. The entrainment-causing self-correlated input signal and the affected feedback canceller filter are called the entraining signal and the entrained filter, respectively.

Entrainment artifacts in audio systems include whistle-like sounds that contain harmonics of the periodic input audio signal and can be very bothersome and occurring with day-to-day sounds such as telephone rings, dial tones, microwave beeps, and instrumental music to name a few. These artifacts, in addition to being annoying, can result in reduced output signal quality. Most previous solutions attempt to address the problem of entrainment and poor adaptive behavior in the presence of tonal and self-correlated signals by distorting the signals, such that they no longer have the properties that trigger these problems. The consequence of such an approach is that the hearing aid output is distorted or corrupted in some way. Thus, there is a need in the art for method and apparatus to reduce the occurrence of these artifacts and hence provide improved quality and performance.

Adverse conditions for an adaptive feedback canceler include conditions in which the feedback in the system is weak relative to the input signal, and conditions in which the input, and therefore output, signal is strongly self-correlated. Self-correlated signals are self-similar over a short time span, that is, similar to slightly delayed versions of themselves. If the signal is similar to a delayed version of itself, then at the hearing aid input, the feedback canceler cannot distinguish new signal from feedback. The simplest case of this self-similarity is a tonal, or pitched signal. A periodic signal is identical to versions of itself delayed by the pitch period, and thus tonal signals, like music, are troublesome for adaptive feedback cancelers.

Feedback cancellation performance degradation manifests itself in the form of reduced accuracy in modeling the feedback path, or misalignment, which results in lower added stable gain and degraded sound quality. In the extreme case of signal self-correlation, the system begins to cancel the signal itself rather than the feedback signal, introducing audible artifacts and distortion. Entrainment artifacts may occur during voiced speech, but are most egregious for music signals, in which persistent tones aggravate the entraining behavior and magnify the artifacts. Output-processing systems, such as output phase modulation (OPM), break down the problematic correlation, restoring the modeling accuracy and reducing misalignment, at the expense of degrading the sound quality of the output, and introducing artifacts of their own. An example of OPM is described in the following commonly assigned U.S. Patent Applications which are herein incorporated by reference in their entirety: "Output Phase Modulation Entrainment Containment for Digital Filters," Ser. No. 11/276,763, filed on Mar. 13, 2006, now issued as U.S. Pat. No. 8,116,473; and "Output Phase Modulation Entrainment Containment for Digital Filters," Ser. No. 12/336,460, filed on Dec. 16, 2008, now issued as U.S. Pat. No. 8,553,899. Like entrainment itself, these artifacts are most objectionable for music signals and some voiced speech.

Disclosed herein, among other things, are apparatus and methods for tonality-driven feedback canceler adaptation for hearing devices. Various embodiments include a method of signal processing an input signal in a hearing device to mitigate entrainment, the hearing device including a receiver and a microphone. The method includes detecting strength of tonality of the input signal by estimating a second derivative of subband phase of the input signal, and adjusting parameters of an adaptive feedback canceler of the hearing device based on the detected tonality. In various embodiments, the estimated second derivative of subband phase of the input signal in one subband or frequency channel is compared with an estimated second derivative of subband phase of the input signal in other subbands or frequency channels, such that tonal signals are distinguished from tones due to feedback oscillation, and parameters of an adaptive feedback canceler of the hearing device are adjusted based on this distinction. In some embodiments, the estimated second derivative of subband phase of the input signal in one subband or frequency channel is compared with an estimated second derivative of subband phase of the input signal in other subbands or frequency channels, such that transient or impulsive input signals are detected, and the adaptation of the adaptive feedback canceler is temporarily halted or constrained to reduce estimation error introduced by the transient or impulsive input signals.

The present subject matter increases overall sound quality and/or improves feedback cancellation performance by proactively detecting tonal input signals and adapting the feedback cancellation and/or the output phase modulation (OPM) parameters accordingly. The present subject matter mitigates entrainment in adaptive feedback cancellation while minimizing degradation of the hearing aid output, thereby improving sound quality for tonal inputs such as speech and music. Thus, the present subject matter improves the performance and/or sound quality of the feedback cancellation by detecting tonal sounds, and modulating the adaptation and/or OPM rate in proportion to the strength of tonal content, using strength of tonality detection.

Tonal or periodic signals cause a steady, predictable phase advance from block-to-block. If the period of the signal is constant, then the amount of phase travel over a fixed unit of time is also constant. Therefore, the subband phase difference from block-to-block, which approximates the first derivative of subband phase, changes relatively little from one block to the next, in bands dominated by energy from tonal signals. Therefore, the block-to-block subband difference of phase difference (which approximates the second derivative of subband phase) is small, near zero, in bands dominated by energy from tonal signals. By estimating the second derivative of subband phase, the strength or dominance of tonal energy in each subband is estimated, in various embodiments. In various embodiments, the second derivative of subband phase can be approximated by computing the block-to-block difference of the block-to-block difference in subband phase. For example, for sample blocks 1, 2 and 3, the difference between blocks 1 and 2 is subtracted from the difference between blocks 2 and 3.

The phase relationship described here holds even for subbands spanning multiple tones or harmonics of a tonal signal. This is because any collection of periodic signals, even a non-harmonic collection, is itself a periodic signal having a period equal to the least common multiple of the component periods. Simulations show that, with appropriate smoothing, this second derivative method of the present subject matter can detect multiple tones within a subband, even in the presence of background noise.

The present subject matter uses detection of tonality or tonal signal energy to govern an adaptive feedback canceler. We define tonality as a quantity that is larger in signals that are dominated by single-frequency components having slowly varying (or non-varying) frequencies (tones), and smaller in signals that are not comprised of such components. Most previous solutions (OPM, probe injection) attempt to address the problem of entrainment and poor adaptive behavior in the presence of tonal and self-correlated signals by distorting the signals, such that they no longer have the properties that trigger these problems. The consequence of such an approach is that the hearing aid output is distorted or corrupted in some way. The method and apparatus of the present subject matter take on a more proactive approach in identifying tonal signals, which are known to cause problems to the feedback canceler, and then manipulate parameters of the feedback cancellation algorithm and/or OPM according to properties of the signals, to render the feedback cancellation less sensitive to entrainment and improper adaptation. Thus, the present subject matter provides a more powerful mechanism for identifying relevant signal properties and appropriate parameter manipulations, by leveraging a tonality detector.

Additional information can be gained by examining the second derivative of phase across frequency channels or subbands. In this way, the method of the present subject matter can distinguish between undesired oscillations (instability as a result of feedback) and desired tonal signals in the input. Feedback oscillation normally is isolated to a single frequency, and would therefore be detected only in one frequency channel. Tonal signals in the environment, such as musical signals, are rarely pure tones, and would be more likely to be detected in multiple frequency channels. Moreover, musical tones most often have significant energy at frequencies below 1500 Hz (the middle key on a piano has a fundamental frequency of approximately 261 Hz), where feedback oscillation rarely occurs. The detection of tonality in the lower hearing aid channels (in which adaptation does not occur) may therefore also be usable as a cue to distinguish tonal environmental signals from feedback oscillation.

FIG. 1 is a diagram demonstrating, for example, an acoustic feedback path for one application of the present system relating to an in-the-ear hearing aid application, according to one embodiment of the present system. In this example, a hearing aid 100 includes a microphone 104 and a receiver 106. The sounds picked up by microphone 104 are processed and transmitted as audio signals by receiver 106. The hearing aid has an acoustic feedback path 109 which provides audio from the receiver 106 to the microphone 104.

Figure 2:
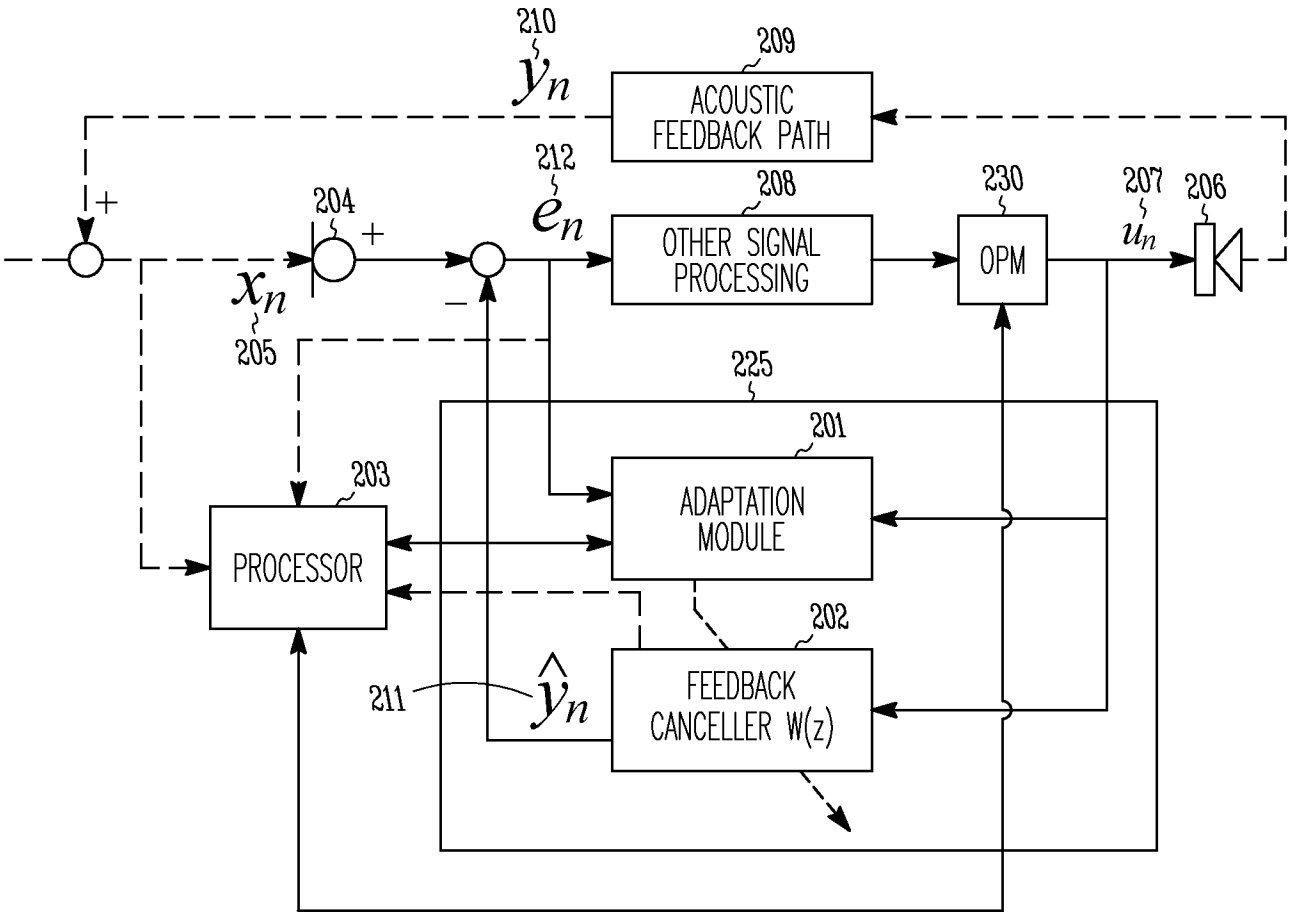
FIG. 2 illustrates an acoustic system with an adaptive feedback cancellation filter according to one embodiment of the present subject matter.

FIG. 2 illustrates an acoustic system 200 with an adaptive feedback cancellation filter 225 according to one embodiment of the present subject matter. The embodiment of FIG. 2 also includes a input device 204, such as a microphone, an output device 206, such as a speaker, processing electronics 208 for processing and amplifying a compensated input signal $e_n$ 212, and an acoustic feedback path 209 with acoustic feedback path signal $y_n$ 210. In various embodiments, the adaptive feedback cancellation filter 225 mirrors the feedback path 209 transfer function and signal $y_n$ 210 to produce a feedback cancellation signal $\hat{y}_n$ 211. When $\hat{y}_n$ 211 is subtracted from the input signal $x_n$ 205, the resulting compensated input signal $e_n$ 212 contains minimal, if any, feedback path 209 components. In various embodiments, the feedback cancellation filter 225 includes an adaptive filter 202 and an adaptation module 201. Various embodiments include using output phase modulation (OPM) 230. The adaptation module 201 adjusts the coefficients of the adaptive filter to minimize the error between the desired output and the actual output of the system. In various embodiments, the processor 203 is configured to detect tonality of the input signal by estimating the second derivative of subband phase of the input signal, and adjust parameters of an adaptive feedback canceler of the hearing device based on the detected tonality. In various embodiments, weighted overlap-add filter banks having subbands are used in the feedback canceller.

Hearing devices typically include at least one enclosure or housing, a microphone, hearing device electronics including processing electronics, and a speaker or "receiver." Hearing devices can include a power source, such as a battery. In various embodiments, the battery is rechargeable. In various embodiments multiple energy sources are employed. It is understood that variations in communications protocols, antenna configurations, and combinations of components can be employed without departing from the scope of the present subject matter. Antenna configurations can vary and can be included within an enclosure for the electronics or be external to an enclosure for the electronics. Thus, the examples set forth herein are intended to be demonstrative and not a limiting or exhaustive depiction of variations.

It is understood that digital hearing devices include a processor. In digital hearing devices with a processor, programmable gains can be employed to adjust the hearing device output to a wearer's particular hearing impairment. The processor can be a digital signal processor (DSP), microprocessor, microcontroller, other digital logic, or combinations thereof. The processing can be done by a single processor, or can be distributed over different devices. The processing of signals referenced in this application can be performed using the processor or over different devices. Processing can be done in the digital domain, the analog domain, or combinations thereof. Processing can be done using subband processing techniques. Processing can be done using frequency domain or time domain approaches. Some processing can involve both frequency and time domain aspects. For brevity, in some examples drawings can omit certain blocks that perform frequency synthesis, frequency analysis, analog-to-digital conversion, digital-to-analog conversion, amplification, buffering, and certain types of filtering and processing. In various embodiments of the present subject matter the processor is adapted to perform instructions stored in one or more memories, which can or cannot be explicitly shown. Various types of memory can be used, including volatile and nonvolatile forms of memory. In various embodiments, the processor or other processing devices execute instructions to perform a number of signal processing tasks. Such embodiments can include analog components in communication with the processor to perform signal processing tasks, such as sound reception by a microphone, or playing of sound using a receiver (i.e., in applications where such transducers are used). In various embodiments of the present subject matter, different realizations of the block diagrams, circuits, and processes set forth herein can be created by one of skill in the art without departing from the scope of the present subject matter.

It is further understood that different hearing devices can embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter is demonstrated for hearing devices, such as hearing aids, including but not limited to, behind-the-ear (BTE), in-the-ear (ITE), in-the-canal (ITC), receiver-in-canal (RIC), invisible-in-canal (IIC) or completely-in-the-canal (CIC) type hearing aids. It is understood that behind-the-ear type hearing devices can include devices that reside substantially behind the ear or over the ear. Such devices can include hearing devices with receivers associated with the electronics portion of the behind-the-ear device, or hearing devices of the type having receivers in the ear canal of the user, including but not limited to receiver-in-canal (RIC) or receiver-in-the-ear (RITE) designs. The present subject matter can also be used in hearing devices generally, such as cochlear implant type hearing devices. The present subject matter can also be used in deep insertion devices having a transducer, such as a receiver or microphone. The present subject matter can be used in devices whether such devices are standard or custom fit and whether they provide an open or an occlusive design. It is understood that other hearing devices not expressly stated herein can be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of signal processing an input signal in a hearing device to mitigate entrainment, the hearing device including a receiver and a microphone, the method comprising:

detecting strength of tonality of the input signal by estimating a second derivative of subband phase of the input signal by comparing a first block-to-block difference of tonal energy in of a first sequence of blocks to a second block-to-block difference of tonal energy of a second sequence of blocks, wherein the first sequence and the second sequence overlap; and adjusting parameters of an adaptive feedback canceler of the hearing device based on the detected strength of tonality.

2. The method of claim 1, wherein detecting strength of tonality of the input signal by estimating the second derivative of subband phase of the input signal includes computing block-to-block difference in subband phase over at least three subband blocks of the input signal.

3. The method of claim 1, wherein detecting strength of tonality of the input signal by estimating the second derivative of subband phase of the input signal includes using weighted overlap-add (WOLA) filter subbands.

4. The method of claim 1, wherein adjusting parameters of an adaptive feedback canceler of the hearing device includes reducing an adaptation rate when a tonal signal is detected.

5. The method of claim 1, wherein adjusting parameters of an adaptive feedback canceler of the hearing device includes increasing an adaptation rate when a tonal signal is detected.

6. The method of claim 1, wherein adjusting parameters of an adaptive feedback canceler of the hearing device includes adjusting or constraining adaptation step size.

7. The method of claim 1, wherein the estimated second derivative of subband phase of the input signal in one subband or frequency channel is compared with an estimated second derivative of subband phase of the input signal in other subbands or frequency channels, such that tonal signals are distinguished from tones due to feedback oscillation, and parameters of an adaptive feedback canceler of the hearing device are adjusted based on the distinction.

8. The method of claim 1, wherein the estimated second derivative of subband phase of the input signal in one subband or frequency channel is compared with an estimated second derivative of subband phase of the input signal in other subbands or frequency channels, such that transient or impulsive input signal are detected, and the adaptation of the adaptive feedback canceler is temporarily halted or constrained to reduce estimation error introduced by the transient or impulsive input signals.

9. The method of claim 1, comprising adjusting phase modulation based on the detected tonality.

10. The method of claim 9, wherein adjusting phase modulation includes reducing phase modulation rate when a tonal signal is detected.

11. The method of claim 9, wherein adjusting phase modulation includes increasing phase modulation rate when a tonal signal is detected.

12. The method of claim 1, wherein the hearing device is a hearing aid.

13. The method of claim 1, wherein detecting strength of tonality of the input signal includes detecting strength of tonality in a subband containing multiple tones.

14. A hearing device, comprising:

a microphone configured to receive audio signals; and a processor configured to process the audio signals to correct for a hearing impairment of a wearer, the processor further configured to:

detect strength of tonality of the audio signals by estimating a second derivative of subband phase of the audio signals by comparing a first block-to-block difference of tonal energy in of a first sequence of blocks to a second block-to-block difference of tonal energy of a second sequence of blocks, wherein the first sequence and the second sequence overlap; and adjust parameters of an adaptive feedback canceler of the hearing device based on the detected strength of tonality.

15. The hearing device of claim 14, wherein the hearing device is a hearing aid.

16. The hearing device of claim 15, wherein the hearing aid is a behind-the-ear (BTE) hearing aid.

17. The hearing device of claim 15, wherein the hearing aid is an in-the-canal (ITC) hearing aid.

18. The hearing device of claim 15, wherein the hearing aid is a completely-in-the-canal (CIC) hearing aid.

19. The hearing device of claim 15, wherein the hearing aid is a receiver-in-canal (RIC) hearing aid.

20. The hearing device of claim 15, wherein the hearing aid is an invisible-in-canal (IIC) hearing aid.

* * * * *